US006363562B1

(12) United States Patent
Bruntz

(10) Patent No.: US 6,363,562 B1
(45) Date of Patent: Apr. 2, 2002

(54) METHOD FOR DELAYED START LAUNDRY WASHING WITH LIQUID DETERGENT

(75) Inventor: Jordan S. Bruntz, Baxter, IA (US)

(73) Assignee: Maytag Corporation, Newton, IA (US)

( * ) Notice: Subject to any disclaimer, the term of this patent is extended or adjusted under 35 U.S.C. 154(b) by 102 days.

(21) Appl. No.: 09/613,001

(22) Filed: Jul. 10, 2000

(51) Int. Cl.[7] ..... D06F 33/02; D06F 39/02
(52) U.S. Cl. ..... 8/158; 68/12.12; 68/12.18
(58) Field of Search ..... 8/158; 68/12.12, 68/12.18

(56) References Cited

U.S. PATENT DOCUMENTS 3,084,530 A * 4/1963 Gabriel ..... 68/12.12
5,207,080 A * 5/1993 Reinhard ..... 68/12.18

* cited by examiner

*Primary Examiner*—Philip Coe
(74) *Attorney, Agent, or Firm*—McKee, Voorhees & Sease, P.L.C.

(57) ABSTRACT

A delay start method of washing laundry allows laundry to be placed in the spin basket of a washing machine, with liquid detergent added to the fabric softener dispenser. After a selected time delay has expired, the basket is spun so as to discharge the detergent onto the laundry. A wash cycle is then started and operated in a normal manner.

11 Claims, 2 Drawing Sheets

METHOD FOR DELAYED START LAUNDRY WASHING WITH LIQUID DETERGENT

BACKGROUND OF THE INVENTION

Conventional laundry washing machines are started at the time the clothes and detergent are loaded into the machine. However, numerous situations exist wherein a delayed start of the washing cycle is desirable. For example, if a dishwasher is operating or someone is taking a shower, and hot water is wanted for the wash cycle, it would be desirable to delay start of the washing machine until the dishwasher and/or shower is finished. It may also be desirable to delay the start of the wash cycle of the washing machine if the user wants the washing cycle to finish at a specified time. Another reason to delay the start of the washing machine is to avoid the noise of the machine, for example if someone is sleeping or trying to watch TV nearby.

It is undesirable to stop the washing machine after it has started, since there may be dye transfer between wet clothes. Therefore, it is desirable to delay the start of the washing machine after the laundry is loaded into the machine but before water is added to the machine.

Accordingly, a primary objective of the present invention is the provision of a delayed start method of operating a laundry washing machine.

Another objective of the present invention is the provision of a method of washing laundry using liquid detergent, which is dispensed after a time delay before the wash cycle starts.

Another objective of the present invention is the provision of a method of washing laundry wherein a timer in the control circuitry is actuated by the user to delay start of the wash cycle.

These and other objectives will become apparent from the following description of the invention.

SUMMARY OF THE INVENTION

In a preferred embodiment, the method of the present invention relates to the delay of the wash cycle for a vertical axis washing machine. More particularly, laundry is placed into the basket of the washing machine, and liquid laundry detergent is added to the fabric softener dispenser. A desired time delay is set by the user using the control circuitry of the machine. After the time delay has expired, the basket goes into a short spin cycle so as to discharge the detergent from the dispenser into the basket. Then, a standard wash cycle is commenced.

In a similar embodiment, the liquid detergent is replaced with particulate detergent, which is placed into a container or platform for discharge when the laundry basket spins following the time delay.

DETAILED DESCRIPTION OF THE INVENTION

Figure 2:
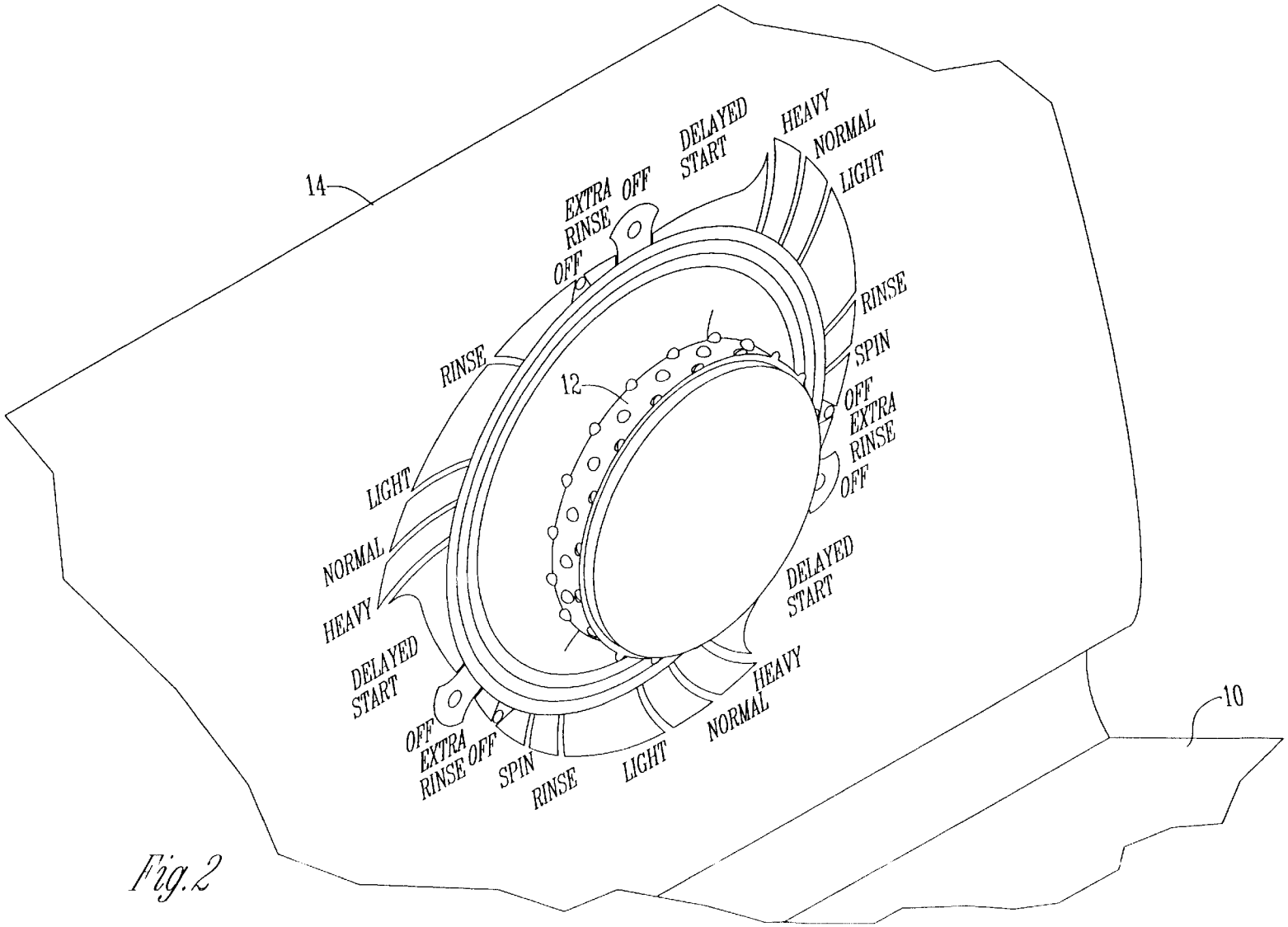
FIG. 2 is a view of the control panel of the machine showing the delay start portion for the control knob.

The delayed start washing operation of the present invention is preferably utilized with a vertical axis washing machine 10 having a rotatable basket for holding laundry, a fabric softener dispenser, and control circuitry for controlling operation of the machine. The structure of the washing machine is conventional, with the exception that the control circuitry includes a variable increment timer. Thus, the control knob 12 on the control panel 14 of the washing machine 10 will include a "delayed start" selection, as shown in FIG. 2. According to the present invention, if the user wants to load the washing machine 10 with laundry to be washed, but wants to delay start of the washing cycle, the desired delay can be set using the knob 12.

Figure 1:
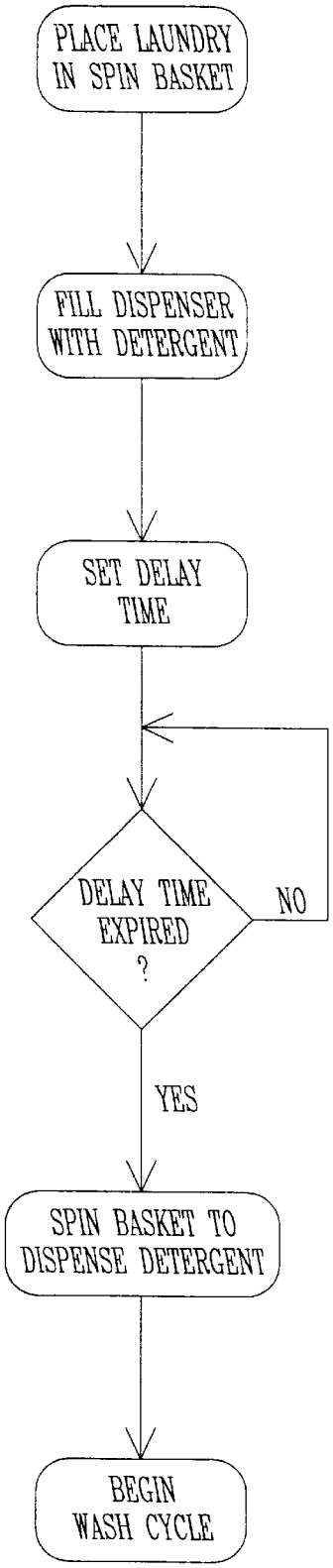
FIG. 1 is a flow chart showing the delay-start method of washing laundry according to the present invention.

The method of the present invention is illustrated by the flow chart in FIG. 1. The user places clothing or laundry into the basket, as in normal operation of the washing machine 10. Liquid detergent is then added to the conventional fabric softener dispenser. Fabric softener cannot be used with the delayed start since the detergent is loaded into the fabric softener dispenser. The user then sets the length of the delay time using the knob 12. The incremental timer of the washing machine 10 will then count down the time delay. Once the time delay has expired, the machine 10 will spin the basket for a short period of time, so as to dispense the detergent into the basket from the fabric softener dispenser. The selected wash cycle will then begin and operate as normal.

In an alternate embodiment, particulate detergent is used, rather than liquid detergent. The particulate detergent is not placed into the fabric softener dispenser, but rather is poured into a platform or container mounted on top of the dispenser, so as to be dispensed therefrom by the centrifugal force when the basket spins after the expiration of the time delay.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A method of washing laundry in a vertical axis washing machine having a rotatable basket for holding laundry, a fabric softener dispenser, and control circuitry for controlling operations of the machine, the method comprising:

placing laundry in the basket;

adding liquid laundry detergent to the fabric softener dispenser;

setting a time delay on the control circuitry;

spinning the basket after the time delay has expired so as to discharge the detergent from the dispenser into the basket; and operating a wash cycle for the machine.

2. A method of washing laundry in a vertical axis washing machine having a rotatable basket for holding laundry, a fabric softener dispenser, and control circuitry for controlling operations of the machine, the method comprising:

placing laundry in the basket;

adding liquid laundry detergent to the fabric softener dispenser; and actuating a timer in the control circuitry to delay start of a wash cycle.

3. The method of claim 2 further comprising spinning the basket after the time delay has expired so as to discharge the detergent from the dispenser into the basket.

4. The method of claim 3 further comprising operating a wash cycle for the machine.

5. A method of washing laundry in a washing machine having a rotatable basket for holding laundry and control circuitry for controlling operation of the machine, the method comprising:

placing laundry in the basket;

putting laundry detergent in a container in the machine; and actuating a timer in the control circuitry to delay start of a wash cycle.

6. The method of claim 5 further comprising dispensing the detergent into the basket after the time delay has expired.

7. The method of claim 5 further comprising operating a wash cycle.

8. The method of claim 5 wherein the detergent is a liquid.

9. The method of claim 5 wherein the detergent is a particulate material.

10. The method of claim 5 wherein the machine is a vertical axis machine.

11. The method of claim 5 wherein the container is a fabric softener dispenser.

* * * * *